United States Patent [19]

Barlew

[11] 4,133,524

[45] Jan. 9, 1979

[54] EXERCISE APPARATUS

[76] Inventor: Israel Barlew, 15212 Cantara St., Van Nuys, Calif. 91402

[21] Appl. No.: 803,618

[22] Filed: Jun. 6, 1977

[51] Int. Cl.[2] ..... A63B 23/02

[52] U.S. Cl. ..... 272/111

[58] Field of Search ..... 272/62, 63, 109, 111, 272/113, 144, 145

[56] References Cited

U.S. PATENT DOCUMENTS

| | | | |
|---|---|---|---|
| 3,077,347 | 2/1963 | Nova | 272/144 X |
| 3,114,545 | 12/1963 | Horn | 272/63 X |
| 3,307,534 | 3/1967 | Gibbs | 272/144 X |
| 3,679,203 | 7/1972 | Grana | 272/111 |
| 3,857,561 | 12/1974 | Cecchettini et al. | 272/144 |
| 3,879,033 | 4/1975 | Martin | 272/111 |
| 4,046,373 | 9/1977 | Kim | 272/144 X |

*Primary Examiner*—Richard J. Apley

*Attorney, Agent, or Firm*—Gerald L. Price

[57] ABSTRACT

An exercise apparatus which assists a person in assuming a shoulder stand or a hanging from the knee position and accomodates either of these positions. The apparatus includes a frame with two side panels between which are mounted a pivot bar, a shoulder support and a knee support bar. To assume either the shoulder stand or hanging from the knees position, the user faces the pivot bar and pivots about it at the midsection of the body. The spacial relationship between the pivot bar, shoulder support and knee support bar permit the user to slowly and carefully pivot into the shoulder stand position utilizing the knee support bar if desired to assist in maintaining the shoulder stand position or to hang free from the knees. When the exercises are completed, the pivot bar supports the user in returning to an upright position.

10 Claims, 4 Drawing Figures

16
4
10
12
11
15
3
3
2
17
18
19
17
13
2
4

16
11
15
18
10
19
13
14

14
17
12
11
13
17
17

15
17
17
11
12

EXERCISE APPARATUS

BACKGROUND OF THE INVENTION

The present invention relates generally to exercise apparatus and more particularly to an improved exercise apparatus which is specifically designed to accomodate shoulder stands and hanging from the knee positions and additionally assist the user in assuming these positions.

It is generally well known and accepted that maintaining the human body for limited periods in a position with the head lower than the feet such as in a head stand or shoulder stand position has certain beneficial attributes such as increasing blood circulation through the upper body. Additionally, hanging upside down from the bends of the knees has been recognized as an exercise and treatment for the spine in as much as it is a form of gravity induced traction. While there are a number of devices known in the prior art for supporting the body in a head or shoulder stand position or a hanging from the knees position in connection with gymnastics, yoga exercises, and physiotherapy, very few of the devices known in the prior art accomodate both shoulder stand and knee hanging positions and those devices which are available that accomodate both of such positions, are large and bulky and generally too costly for non-institutional applications.

SUMMARY OF THE INVENTION

Accordingly, it is the general aim of the present invention to provide a new and improved exercising apparatus which accomodates the user in both shoulder stands and knee hanging positions and yet is more compact and portable than exercising and therapy devices which have heretofore been available. A related object of this invention is to provide an improved exercising apparatus which assists and supports the user in assuming an inverted shoulder stand or a knee hanging position and further assists and supports the user in returning to an upright position once the exercises are completed.

It is another object of the invention to provide a relatively low cost exercise device which is made of a minimum of parts thus simplifying the manufacturing and packaging of same and which is capable of being rapidly and readily assembled and disassembled for respective use and storage.

BRIEF DESCRIPTION OF THE DRAWINGS

Other objects and advantages of the present invention, along with the interrelationship between the elements of the preferred embodiment, will become more apparent when considered in connection with the specification and accompanying drawings in which.

Figure 1:
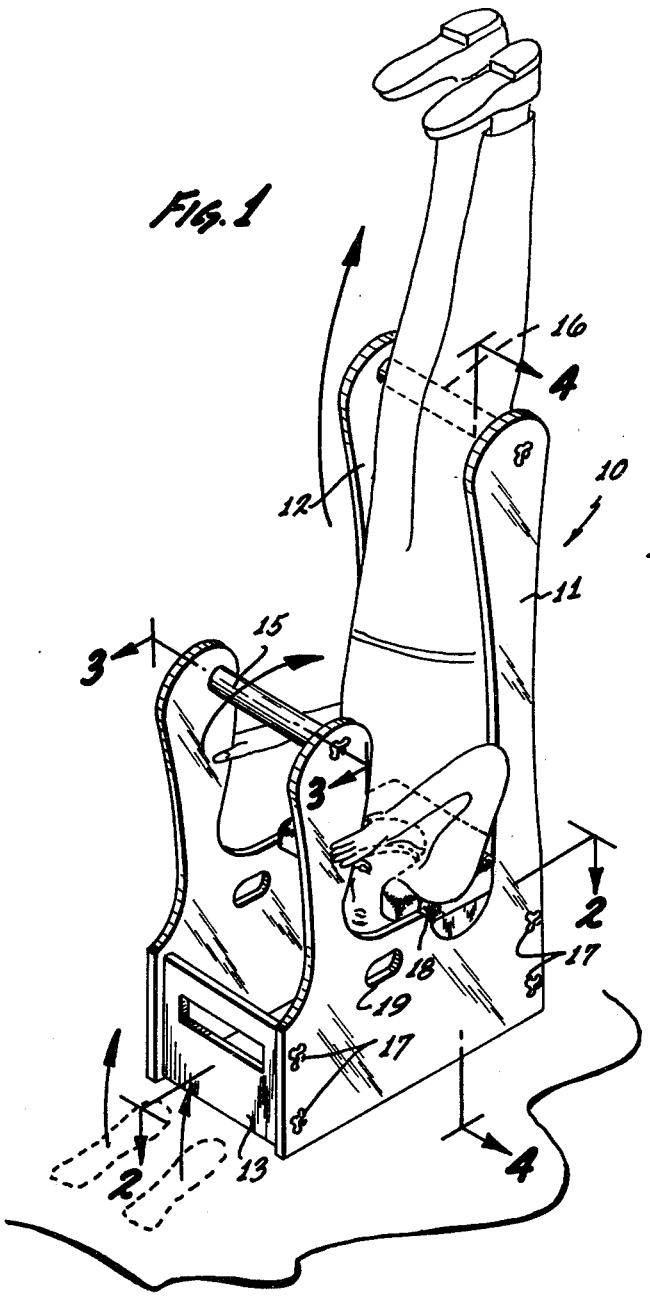
FIG. 1 is a perspective view of an exemplary exercising device embodying the features of the present invention and illustrating a person utilizing the device in a shoulder stand position with additional leg support.
Figure 4:
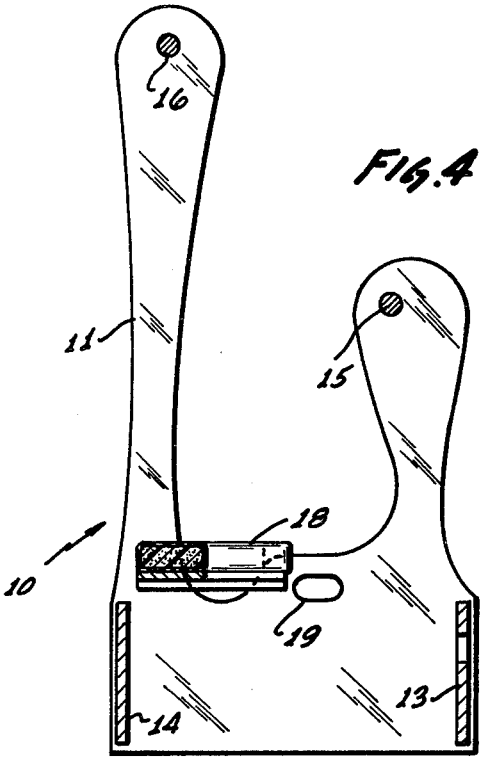
FIG. 4 is a sectional view, taken substantially along the line 4—4 of FIG. 1.

While the present invention is susceptible of various modifications and alternative constructions and can be used with various types of materials and overall designs, illustrative embodiments are shown in the drawings and will hereinafter be described in detail. It should be understood, however, that it is not intended to limit the invention to the particular embodiment disclosed, but, on the contrary, the intention is to cover all equivalents and alternative constructions falling within the spirit and scope of the invention as expressed in the appended claims.

DESCRIPTION OF THE PREFERRED EMBODIMENT

Referring now to FIGS. 1 through 4, an exemplary exercise device generally indicated at 10, is illustrated, the unit including a generally rectangular frame comprised of a right side panel 11, a left side panel 12, a front support panel 13, and a rear support panel 14.

In accordance with one of the important aspects of the present invention, provision is made for assuming a shoulder stand or a hanging from the knee position and accomodating either of these positions once they are assumed. This is accomplished by providing a support for the shoulders and a bar from which to hang from the inside of the knees. In the exemplary apparatus, a yolk shaped shoulder pad 18 is mounted between the left and right side panels with the yolk portion permitting the head to pass through and the shoulders to engage the padded upper surface at each side of the yolk. In order to assist the user in balancing in a shoulder stand or to support the user in a hanging from the knee position, a knee hanging bar 16 is mounted between the right and left hand side panels at a height which corresponds generally to the location of the inside of the knees when the user is in an extended inverted position with the shoulder supported on the shoulder support 18.

In accordance with another important aspect of the present invention provision is made to assist and support the user in assuming a shoulder stand or hanging from the knees position and in returning to an upright position thereafter. To accomplish this, a pivot bar 15 is mounted between the right and left side panels at the front position thereof and at a height which generally conforms to the midsection of the user. Thus, when the user desires to assume a shoulder stand position for example, the feet of the user are positioned as indicated in the dotted lines in FIG. 1 and the user then leans into the pivot bar 15 at the midsection and pivots about the pivot bar into the inverted shoulder stand position. It will be readily apparent by referring to FIGS. 1 and 4, that in the event the user loses balance in assuming the shoulder stand position, the knee hanging bar 16 will serve to prevent the user from falling rearwardly and sustaining a possible injury. In order to return to an upright position, the aforestated steps are essentially reversed with the user leaning the midsection into the pivot bar 15 and pivoting about to the upright starting position.

Referring to FIG. 1, it can be readily seen that in addition to the shoulder stand position, if the user desires to hang from the inside of the knees, all that is necessary from the shoulder stand position is to bend the knees about the knee hanging bar 16 and the hanging position will be readily assumed. Additionally, the design of the instant apparatus enables the user to return to a shoulder support position at any desired time.

Figure 2:
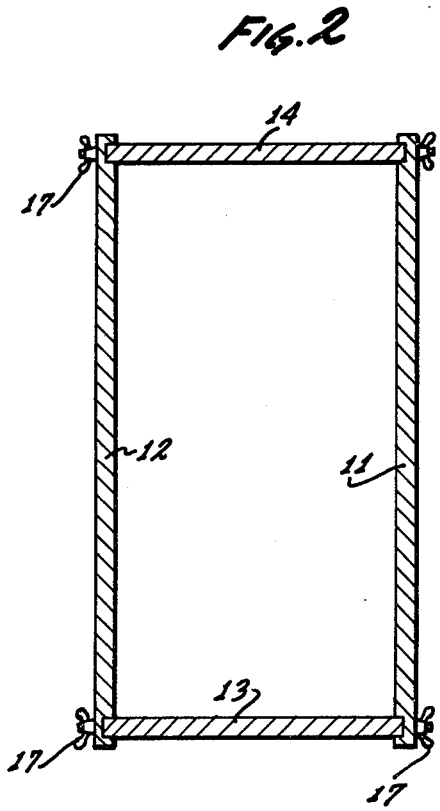
FIG. 2 is a sectional view, taken substantially along the line 2—2 of FIG. 1.
Figure 3:
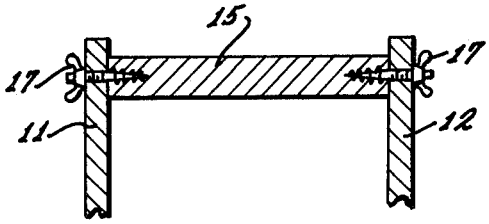
FIG. 3 is a fragmentary sectional view, taken substantially along the line 3—3 of FIG. 1.

In order to rapidly and securely assemble and disassemble the apparatus, the front support panel 13, the rear support panel 14, and the pivot bar 15 and knee hanging bar 16 are all provided with extending machine screw threads which extend through the right and left hand side panels where they can be rapidly secured with wing nuts 17. It will be readily apparent to one skilled in the art that for additional capacity and strength, a metal bar could be placed all the way through the pivot bar and the knee hanging bars rather than the wood screw type fastners utilized in the illustrated embodiment as shown in FIG. 3. Additionally, handle cutouts 19, can be provided as shown in FIGS. 1 and 2, to assist the user in maintaining a shoulder stand position.

Having described my invention, I claim:

1. An exercise device for accommodating a user in a shoulder stand position and a hanging from the knees position and assisting a user in assuming and maintaining these positions comprising:

a frame comprising two upright and generally parallel members spaced a distance apart which is greater in width than a user;

shoulder support means mounted between said upright members for supporting the shoulders of the user; and a substantially horizontal pivot bar mounted between said upright members and forward of said shoulder support means at a height, generally corresponding to a user's midsection and at a distance forward of and above said shoulder support means by a distance generally conforming to the distance between the midsection and shoulders of a user whereby when a user faces and leans against said pivot bar and pivots about same, the user will assume an inverted position with the shoulders of the user resting on said shoulder support means.

2. The exercise device set forth in claim 1 wherein said shoulder support means is positioned above a support surface engaging portion of said frame and comprises a generally horizontal flat shoulder engaging portion with a u-shaped opening therebetween to allow the user's head to freely hang when the user's shoulders are supported thereon.

3. The exercise device set forth in claim 2 further comprising:

a substantially horizontal knee hanging bar mounted between said upright members and just rearward of the shoulder engaging portion of said shoulder support means and a distance above said shoulder support means substantially the same as a distance generally conforming to the distance between the inside of the user's knees and their shoulders when the user is in an extended shoulder stand position with the user's shoulders supported on said shoulder support means.

4. The exercise device set forth in claim 3 wherein said pivot bar, said knee hanging bar and said upright members are held together with removable fastner means.

5. The exercise device set forth in claim 4 wherein said fastner means comprises threaded shafts extending from each end of said bars and passing through said upright members when they are secured with nuts.

6. The exercise devices set forth in claim 2 wherein said shoulder support means is located at a height above the ground greater than the distance from the user's shoulder to the top of the user's head.

7. The exercise device set forth in claim 1 wherein each of said upright members are of a flat planar configuration.

8. The exercise device set forth in claim 2 wherein each of said upright members are of a flat planar configuration.

9. The exercise device set forth in claim 3 wherein each of said upright members are of a flat planar configuration.

10. The exercise device set forth in claim 2 wherein said shoulder engaging portion of said shoulder support means is padded.

* * * * *